US005687248A

United States Patent [19]

Yen et al.

[11] Patent Number: 5,687,248

[45] Date of Patent: Nov. 11, 1997

[54] LIGHT WEIGHT AND LOW MAGNETIC LEAKAGE LOUDSPEAKER

[75] Inventors: Kun-Lung Yen, Chia-I Hsien; Dar-Ming Chiang, Hsinchu, both of Taiwan

[73] Assignee: Industrial Technology Research Institute, Hsinchu, Taiwan

[21] Appl. No.: 643,238

[22] Filed: May 2, 1996

[51] Int. Cl.[6] ..... H04R 25/00

[52] U.S. Cl. ..... 381/201; 381/199

[58] Field of Search ..... 381/199, 194, 381/192, 202, 201, 204

[56] References Cited

U.S. PATENT DOCUMENTS

| | | | |
|---|---|---|---|
| 5,321,762 | 6/1994 | Stuart | 381/199 |
| 5,390,257 | 2/1995 | Oslac | 381/199 |

OTHER PUBLICATIONS

Electrical Technology (vol. 64, No. 8, 1990, of Mitsubishi Japan).

*Primary Examiner*—Sinh Tran

*Attorney, Agent, or Firm*—Ladas & Parry

[57] ABSTRACT

A magnetic circuit applied for loudspeakers includes a cup-shaped yoke, a primary magnet, a surrounding top plate, a first central top plate, and a thin magnet. The cup-shaped yoke includes a bottom part and a ring part. The primary magnet is located within the bottom part of the yoke and serves as a magnetic field source. The surrounding top plate and the first central top plate are respectively located on the ring part of the yoke and the primary magnet. A air gap between the surrounding top plate and the first central top plate is formed and used for accommodating a voice coil, which may actuate a diaphragm to emit sound. The thin magnet is located on the first central top plate and repels the primary magnet magnetically. Therefore, the magnetic leakage above the air gap can be strongly reduced. In addition, an additional second central top plate is mounted on the thin magnet and may serve as magnetic shielding.

15 Claims, 3 Drawing Sheets

LIGHT WEIGHT AND LOW MAGNETIC LEAKAGE LOUDSPEAKER

BACKGROUND OF THE INVENTION

1. Field of the Invention

The present invention relates in general to a loudspeaker, and particularly to a loudspeaker which has advantages of small volume, light weight, and low magnetic leakage.

2. Description of Related Arts

Most of loudspeakers utilize permanent magnets and voice coils to actuate an oscillator, such as a diaphragm, to produce sound with various pitches. The loudspeaker of this type establishes a magnetic circuit by utilizing permanent magnets and bulks of magnetic conducting material and by maintaining an air gap within the magnetic circuit. The air gap accommodates a voice coil carrying currents. The permanent magnet, which is usually made of ferrite material, encircles the bulks of magnetic conducting material. A driving force, produced by interacting the magnetic field and the current flowing through the voice coil according to Lorentz's equation, is applied to the voice coil and then actuates the diaphragm coupled to the voice coil. The loudspeaker of this kind is referred to as an external-magnetic type. Such a structure may increase the loudspeaker's volume and weight. In addition, a large amount of magnetic leakage exists at the top and its sides. Therefore, efficiency of the permanent magnet's utilization is quite low.

As the information industry develops, personal computers are involved in multimedia applications. Therefore, loudspeakers are applied to personal computers and serve as an important peripheral device component of a multimedia system. Conventional coil-actuating loudspeakers are apparently incapable of satisfying the requirements, in terms of size and weight, of this application. Furthermore, cathode radiation tubes (CRT), often used in the display monitors (display) of personal computers, are sensitive to external magnetic fields. Thus, conventional loudspeakers that have high magnetic leakage may cause chroma irregularities, image twisting and flashing, and then are inappropriate for assembling with monitors.

Several technologies for improvement have been developed to cope with these drawbacks. In Electrical Technology (Vol. 64, No. 8, 1990) of Mitsubishi, Japan, a novel coil-actuating loudspeaker is disclosed, where utilization of the external magnetic structure and ferrite magnets is still maintained. The improvement approach is to mount an opposite magnet that repels the primary magnet at the bottom and to seal the whole structure with bucks of magnetic conducting material. Such an approach is truly capable of lessening the lateral magnetic leakage of the magnetic circuit, but has little or no effect upon the top magnetic leakage over the air gap. In addition, adding the supplementary magnet will increase the magnetic circuit's volume and weight.

U.S. Pat. No. 5,321,762 discloses an internal magnetic circuit, compared with the mentioned external one, which has a radially polarized magnet and a core encircling the radially polarized magnet. Such a scheme is able to minimize the nonuniformity and infringing of the magnetic field, but still can not solve the problem of the magnetic leakage over the air gap. In addition, the radially polarized magnet, which may be constructed from a plurality of arc segments of radially polarized magnetic material, is difficult to assemble and may increase production cost.

U.S. Pat. No. 5,390,257 disclose another internal magnetic circuit. Its feature is that a magnet having the same volume as the main magnet and repelling the main magnet is mounted over the main magnet. The main magnet and the repelling magnet can be of neodymium material. Therefore, the loudspeaker of this type has light weight and small volume, and is quite easy to assemble. Furthermore, such a construction of the main magnet and the repelling magnet is capable of reducing the loudspeaker's distortion and upgrade its sensitivity. However, its drawback is that the magnetic field near the air gap will be nonuniform due to the arrangement of magnets. In addition, the problem of the magnetic leakage over the air gap is still not solved.

SUMMARY OF THE INVENTION

The first object of the present invention is to provide a magnetic circuit that will produce less magnetic leakage that might interfere with a neighboring CRT monitor than the conventional ones do. In addition, such a magnetic circuit can also upgrade the magnetic energy efficiency of the primary magnet therein.

The second object of the present invention is to provide a light-weight loudspeaker that will generate low magnetic leakage. Such a loudspeaker is more conveniently assembled into a multimedia computer system than the conventional ones.

According to the foregoing objects, the present invention provides a magnetic circuit, which has a primary magnet, a yoke, a first central top plate, a surrounding top plate, and a thin magnet. The yoke can be divided into a bottom part and a ring part fixed on the periphery of the bottom part. The permanent magnet having a first surface and a second opposing surface and the first surface therein is located in contact with the bottom part of the yoke. The first central top plate is located on the second opposing surface of the primary magnet and the surrounding top plate is located on the ring part of the yoke. An air gap between the first central top plate and the surrounding top plate is formed. Then the primary magnet, the first central top plate, the surrounding top plate and the yoke may form a closed-loop magnetic circuit. The thin magnet, which repels the primary magnet, is located on the first central top plate to reduce the magnetic leakage from the air gap. In addition, a second central top plate can be mounted on the thin magnet for further reducing the magnetic leakage over the thin magnet. In addition, the ring part of the yoke has a groove located in contact with the surrounding top plate, for confining the magnetic energy contained in the air gap.

Using the above-mentioned magnetic circuit, the present invention is capable of providing a novel loudspeaker. Besides the above-mentioned magnetic circuit, the loudspeaker further comprises a bobbin, a voice coil wound on the bobbin and located within the air gap, and a diaphragm connected to the bobbin for emitting sound. The voice coil may interact with the closed-loop magnetic circuit to produce a force perpendicular to the direction of the current flowing through the voice coil and to the direction of the closed-loop magnetic circuit. Then the diaphragm oscillates to emit sound according to the force. Furthermore, a supporting means can be used to support the diaphragm and prevent the transverse movement of the diaphragm. The supporting means comprises a frame, an edge, and a damper. The frame has a first rim portion fixed to the surrounding top plate and a second opposing rim portion connected to the diaphragm. The damper is connected between the frame and the diaphragm. Furthermore, a cap is used to prevent the closed-loop magnetic circuit from dust contamination.

BRIEF DESCRIPTION OF THE DRAWINGS

The detailed description of an embodiment of the present invention is made with reference to the accompanying drawings, wherein.

DETAILED DESCRIPTION OF THE PREFERRED EMBODIMENT

The magnetic circuit applied to the loudspeaker of the present invention is characterized in that (a) a primary permanent magnet serving as a magnetic field source is encircled by a cup-shaped yoke, to form a closed, magnetic conduction loop; and (b) a thin magnet, which repels the primary permanent magnet, is mounted over the primary permanent magnet, to suppress the magnetic leakage. Such arrangements can promote magnetic energy efficiency.

Figure 1:
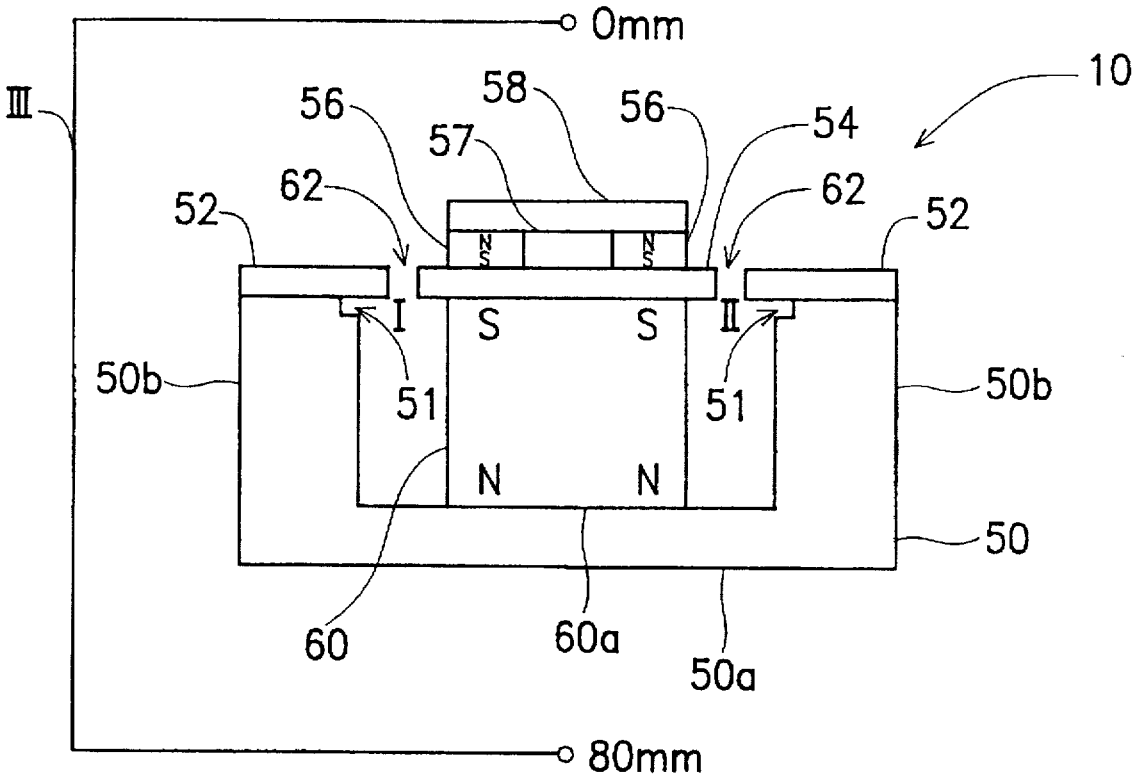
FIG. 1 is a cross sectional view of the magnetic circuit used for driving a voice coil in the embodiment of the present invention.

FIG. 1 schematically shows a cross sectional view of a magnetic circuit applied to the loudspeaker of this embodiment. The main magnetic loop begins from the N-pole (north pole) of primary magnet 60, passes through yoke 50, surrounding top plate 52, first central top plate 54, and then ends with the S-pole (south pole) of primary magnet 60. Primary magnet 60 may be made of rare earth magnetic materials, such as $SmCo_5$, $Sm_2CO_{17}$ and NdFeB systems, which have high magnetic energy density, to reduce weight of the assembly. In addition, yoke 50, surrounding top plate 52 and first central top plate 54 may be made of high magnetic flux conducting material, such as low carbon steel, to confine the magnetic flux and prevent lateral magnetic leakage.

The detailed descriptions of the magnetic circuit structure are stated as follows. Cup-shaped yoke 50 includes bottom part **50*a* and ring part 50*b* fixed on the periphery of the bottom part 508. Bottom part 50*a* and ring part 50*b* should preferably be inseparable. Primary magnet 60, which is cylindrical in shape, is immediately adjacent to and attached to the bottom part 50*a* by glue 60*a*, and serves as a magnetic field source. In this embodiment, the upper surface of primary magnet 60 is S-pole and the lower surface of primary magnet 60 is N-pole. First central top plate 54 and surrounding top plate 52 are respectively mounted on the primary magnet 60 and the ring part 50*b* of yoke 50. In addition, surrounding top plates 52 and first central top plate 54 are horizontally spaced apart a distance and form an annular air gap 62 between them for accommodating voice coils. However, the width of air gap 62 is preferably as small as possible, to avoid divergence of the magnetic field near this region. A circular groove 51 formed on the inner upper portion of ring part 50*b* is used to confine the magnetic energy contained in air gap 62. In addition, an annular thin magnet 56, which repels primary magnet 60, is mounted on first central top plate 54, to further confine the magnetic energy at the upper space of air gap 62. It is well known that the resulting magnetic flux of two adjacent and opposite magnet poles will be compressed and extend into the perpendicular line between them. Therefore, the original magnetic leakage above the air gap 62 will be guided into the air gap 62 and minimized. In addition, thin magnet 56 can also enforce the magnetic flux density in air gap 62**.

Note that thin magnet 56 itself will also produce a magnetic field in the upper region (above the N-pole of thin magnet 56 depicted in FIG. 1), so it will also generate unwanted magnetic leakage. Two approaches can be taken to minimize such an effect. The first approach is to mount a second central top plate 58 onto thin magnet 56 to serve as magnetic shielding. Second central top plate 58 may be made of high magnetic flux conducting material, such as low carbon steel. The second approach is to lower the magnetic field strength of thin magnet 56. It is enough to achieve required confinement of the magnetic field that thin magnet 56 has a thickness of less than or equal to 1.5 mm. In addition, thin magnet 56 may be annular because the magnetic field originating from the peripheral portion of thin magnet 56 is useful for lessening the magnetic leakage above air gap 62, while that of the central portion of thin magnet 56 is undesirable. After calculation and verification, it has been determined that the ratio of the radius of the inner circle of thin magnet 56 and that of primary magnet 60 should be between 0.37 and 0.43, to acquire best magnetic leakage performance.

Figure 2A:
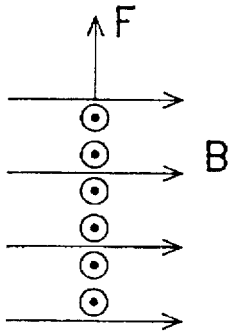
FIGS. 2A and 2B are force diagrams of a voice coil horizontally positioned within the air gap of the magnetic circuit, where FIG. 2A relates to the region I in FIG. 1 and FIG. 2B to the region II in FIG. 1.
Figure 2B:
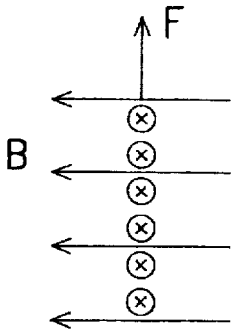

FIG. 2A and 2B respectively illustrate the force diagrams near regions I and II in FIG. 1, where "●" denotes currents directed out of the paper, and "x" denotes currents directed into the paper. In FIG. 2A, the resulting force F acting on a current-carrying object perpendicularly positioned within the magnetic field B is upward, according to Lorentz's law, where the direction of B is from left to right and the direction of current is out of the paper. Meanwhile, the resulting force F in FIG. 2B is also upward, where the direction of the magnetic field B is from right to left and the direction of current is into the paper. Therefore, the object accommodated in air gap 62, such as a voice coil, will be subjected to a force of upward direction. In addition, the magnitude of the force acting on the object is proportional to the total current value flowing across the air gap 62, which in the case of the voice coil also depends on its number of turns, and the magnitude of the magnetic field B. If the current flowing through the voice coil is time-varying, a time-varying force will also be generated.

Figure 3:
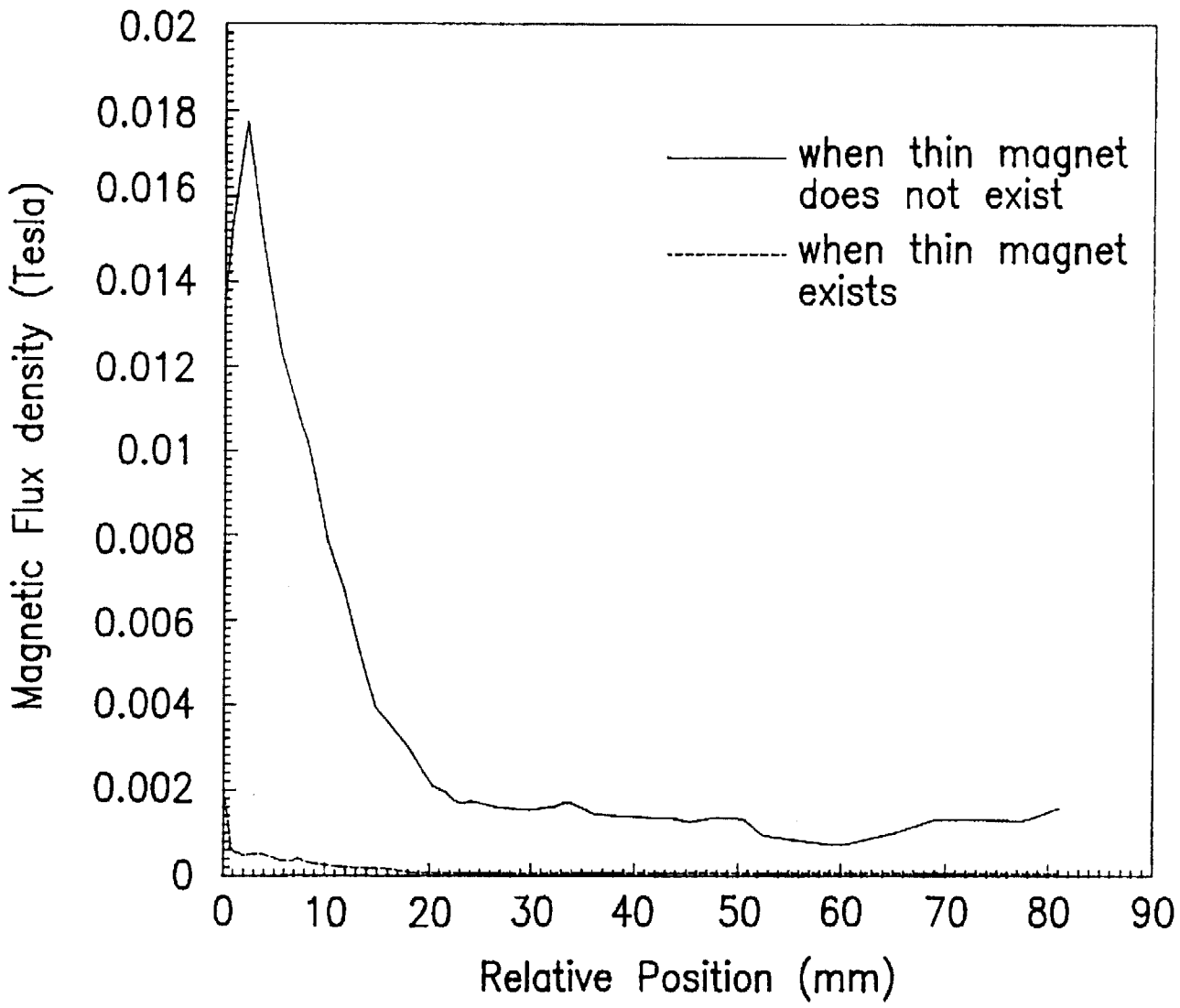
FIG. 3 is a graph showing the calculated magnetic leakage along test line III in FIG. 1.

FIG. 3 is a graph showing the magnetic flux density of the calculated magnetic leakage along test line III in FIG. 1. The distance between the test line III and the outer surface of the magnetic circuit 10 is 10 mm, and the total length of the test line III is 80 mm. Relative positions on the test line III are respectively specified as their corresponding length (0 mm–80 mm). If thin magnet 56 does not exist (in the case of solid line), a large amount of magnetic leakage along the test line III will be found, especially near the upper space of the air gap 62. However, if the thin magnet 56 exists (in the case of dash line), the magnetic flux density of the calculated magnetic leakage along the test line III can be strongly reduced.

It should be noticed that magnetic leakage of magnetic circuit 10 may not be completely contributed to divergence of the magnetic field near the air gap. According to Maxwell's electromagnetic equations, a loop circuit carrying currents will generate a magnetic field in its neighboring environs. While a voice coil is contained in a magnetic circuit, it is inevitable that a portion of induced magnetic field originating from the voice coil itself will diverge and cause magnetic leakage. However, in this embodiment of the present invention, thin magnet 56 can still be used to confine the induced magnetic field and guide it into the normal magnetic circuit.

Figure 4:
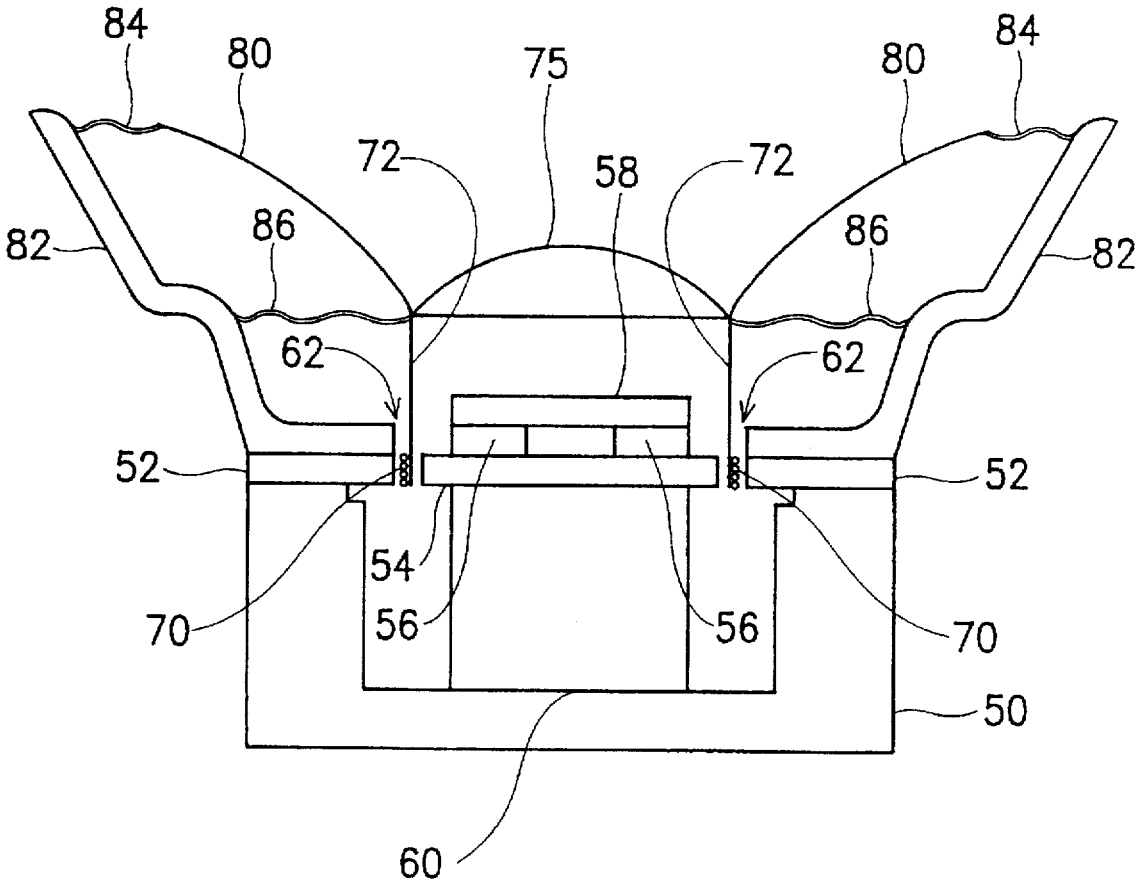
FIG. 4 is a cross sectional view of a loudspeaker in the embodiment of the present invention.

Using magnetic circuit 10 shown in FIG. 1, a light-weight, small-volume, low-leakage, and high-efficiency loudspeaker can easily be constructed. FIG. 4 is a cross sectional view of a loudspeaker in this embodiment. All components except those in magnetic circuit 10 are described as follows. Voice coil 70 fixedly wound on bobbin 72 is located in air gap 62 and interacts with the magnetic field existing in air gap 62 to generate a driving force, whose direction is perpendicular to the direction of the current flowing through the voice coil 70 and to the direction of the magnetic field. Cone-shaped diaphragm 80, connected to bobbin 72, is subjected to the driving force. The driving force varies with the variation of the current flowing through voice coil 70, then diaphragm 80 will emit sound with various pitches according to the driving force. Frame 82, edge 84, and damper 86 are used to support diaphragm 80. Frame 82 is similar to a truncated cone in this embodiment and can be made of aluminum, magnesium, aluminum and magnesium alloy, plastic, or enforced plastic to reduce its weight. The lower rim portion of frame 82 is connected to surrounding top plate 52. In corresponding fashion, the upper rim portion of frame 82 is connected to edge. 84, which is further connected to diaphragm 80. Damper 86 has broader width than edge 84 and is also connected between frame 82 and diaphragm 80. It should be noted that edge 84 and damper 86 are not only used to support diaphragm 80, but also to prevent the transverse movement of diaphragm 80. In addition, cap 75 can be used to cover magnetic circuit 10, especially the region near primary magnet 60, to prevent dust contamination.

The loudspeaker in this embodiment can also be used as a tweeter by adjusting the height of the bobbin 72. In addition, while diaphragm 80 oscillates vertically, cap 76 will not be in contact with the thin magnet 56 or the second central top plate 56. This is also because thin magnet 56 has a thickness of less than or equal to 1.5 mm. In addition, the driving force acting on voice coil 70 in such a configuration is quite uniform, so that the loudspeaker can emit a sound with low distortion.

The foregoing description of preferred embodiments in the present invention has been provided for the purposes of illustration and description. It is not intended to be exhaustive or to limit the invention to the precise forms disclosed. Many modifications and variations will be apparent to practitioners skilled in this art. The embodiments were chosen and described to best explain the principles of the invention and its practical application, thereby enabling others skilled in the act to understand the invention for various embodiments and with various modifications as are suited to the particular use contemplated. It is intended that the scope of the invention be defined by the following claims and their equivalents.

What is claimed is:

1. A magnetic circuit, comprising:

a yoke having a bottom part and a ring part fixed on the periphery of said bottom part;

a primary magnet having a first surface and a second opposing surface, said first surface located in contact with said bottom part of said yoke;

a first central top plate located on said second opposing surface of said primary magnet;

a surrounding top plate located on said ring part of said yoke and maintaining an air gap with said first central top plate such that said primary magnet, said first central top plate, said surrounding top plate and said yoke forming a closed-loop magnetic circuit;

a thin magnet located on said first central top plate, which repels said primary magnet, to lessen the magnetic leakage, the thin magnet having a thin magnet thickness of 1.5 mm or less; and a second central top plate of high magnetic flux conducting material located on said thin magnet for reducing magnetic leakage above said thin magnet.

2. A magnetic circuit as recited in claim 1, wherein said ring part of said yoke has a groove located in contact with said surrounding top plate.

3. A magnetic circuit as recited in claim 1, wherein said primary magnet is made of the magnet group selected from the group consisting of $SmCO_5$, $Cm_2CO_{17}$, and NdFeB.

4. A magnetic circuit as recited in claim 1, wherein said thin magnet is annular.

5. A magnetic circuit as recited in claim 4, wherein the ratio of the radius of the inner circle of said thin magnet and the radius of said primary magnet is between 0.37 and 0.43.

6. A magnetic circuit as recited in claim 1, wherein said yoke, said first central top plate, and said surrounding top plate are made of low carbon steel.

7. A magnetic circuit as recited in claim 1, wherein said second central top plate is made of low carbon steel.

8. A loudspeaker, comprising:

a yoke having a bottom part and a ring part fixed on the periphery of said bottom part;

a primary magnet having a first surface and a second opposing surface, said first surface located in contact with said bottom part of said yoke;

a first central top plate located on said second opposing surface of said primary magnet;

a surrounding top plate located on said ring part of said yoke and maintaining an air gap with said first central top plate such that said primary magnet, said first central top plate, said surrounding top plate and said yoke forming a closed-loop magnetic circuit;

a thin magnet located on said first central top plate, which repels said primary magnet, to lessen the magnetic leakage, the thin magnet having a thin magnet thickness of 1.5 mm or less;

a second central top plate of high magnetic flux conducting material located on said thin magnet for reducing magnetic leakage above said thin magnet, a bobbin;

a voice coil wounded on said bobbin and located within said air gap, wherein said voice coil may interact with said closed-loop magnetic circuit to produce a force, whose direction is perpendicular to the direction of the tangent of said voice coil and to the direction of said closed-loop magnetic circuit; and a diaphragm connected to said bobbin for sounding by said force.

9. A loudspeaker as recited in claim 8, further comprising a means for supporting said diaphragm, said supporting means comprising:

a frame having a first rim portion and a second opposing rim portion, said first rim portion of said frame fixed to said surrounding top plate;

an edge connected between said second opposing rim portion of said frame and said diaphragm, for supporting said diaphragm; and a damper connected between said frame and said diaphragm for supporting said diaphragm and preventing the transverse movement of said diaphragm.

10. A loudspeaker as recited in claim 9, wherein said frame is made of a material selected from the group consisting of aluminum, magnesium, alloy of aluminum and magnesium, plastics and enforced plastics.

11. A loudspeaker as recited in claim 8, further comprising a cap for preventing dust contamination of said closed-loop magnetic circuit.

12. A loudspeaker as recited in claim 8, wherein said diaphragm is cone-shaped.

13. A loudspeaker as recited in claim 8, wherein said thin magnet is annular.

14. A loudspeaker as recited in claim 13, wherein the ratio of the radius of the inner circle of said thin magnet and the radius of said primary magnet is between 0.37 and 0.43.

15. A loudspeaker as recited in claim 8, wherein said primary magnet is made of the magnet group selected from the group consisting of $SmCo_5$, $Sm_2Co_{17}$, and NdFeB.

* * * * *